US009359946B2

(12) United States Patent
Nishikawa et al.

(10) Patent No.: US 9,359,946 B2
(45) Date of Patent: Jun. 7, 2016

(54) INTERNAL COMBUSTION ENGINE AND METHOD FOR MANUFACTURING THE SAME

(75) Inventors: Naoki Nishikawa, Miyoshi (JP); Takumi Hijii, Toyota (JP); Akio Kawaguchi, Shizuoka-ken (JP); Ryouta Yatsuduka, Ikeda (JP); Fumio Shimizu, Toyota (JP); Yoshifumi Wakisaka, Nagoya (JP); Hidemasa Kosaka, Nissin (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 127 days.

(21) Appl. No.: 14/344,494

(22) PCT Filed: Sep. 11, 2012

(86) PCT No.: PCT/IB2012/001750

§ 371 (c)(1), (2), (4) Date: Mar. 12, 2014

(87) PCT Pub. No.: WO2013/038249

PCT Pub. Date: Mar. 21, 2013

(65) Prior Publication Data

US 2014/0245994 A1 Sep. 4, 2014

(30) Foreign Application Priority Data

Sep. 12, 2011 (JP) ..... 2011-198812

(51) Int. Cl.

| | |
|---|---|
| ***F02B 75/08*** | (2006.01) |
| ***F02B 77/11*** | (2006.01) |
| ***C25D 11/24*** | (2006.01) |
| ***C25D 11/26*** | (2006.01) |
| ***F02F 1/00*** | (2006.01) |
| ***F02F 3/14*** | (2006.01) |

(Continued)

(52) U.S. Cl.

CPC ..... *F02B 77/11* (2013.01); *C25D 11/246* (2013.01); *C25D 11/26* (2013.01); *F02F 1/00* (2013.01);

(Continued)

(58) Field of Classification Search

CPC ..... F02B 77/11; F02B 77/02; F02F 1/004; F02F 3/14; F02F 2001/008; Y10T 29/49231; Y10T 29/49272; F05C 2225/00; F05C 2203/0886; C25D 11/26; C25D 11/246

USPC ..... 123/668–670; 205/151, 172, 174

See application file for complete search history.

(56) References Cited

U.S. PATENT DOCUMENTS 7,838,120 B2 * 11/2010 Yamamoto ..... C25D 11/024 205/324

8,893,693 B2 * 11/2014 Hijii ..... C25D 11/04 123/668

(Continued)

FOREIGN PATENT DOCUMENTS

JP 07-062595 A 3/1995

JP 7-216588 A 8/1995

(Continued)

OTHER PUBLICATIONS

International Search Report Issued Jun. 7, 2013 in PCT/IB12/001750 Filed Sep. 11, 2012.

(Continued)

*Primary Examiner* — Hai Huynh

(74) *Attorney, Agent, or Firm* — Oblon, McClelland, Maier & Neustadt, L.L.P.

(57) ABSTRACT

An internal combustion engine having an anodic oxidation coating formed on at least a part of a wall surface that faces a combustion chamber, wherein the anodic oxidation coating has voids and nano-holes smaller than the voids; at least part of the voids are sealed with a sealant derived by converting a sealing agent; and at least a part of the nano-holes are not sealed.

7 Claims, 7 Drawing Sheets

(51) Int. Cl.

| | |
|---|---|
| *C25D 11/08* | (2006.01) |
| *F02B 77/02* | (2006.01) |
| *F02F 1/24* | (2006.01) |

(52) U.S. Cl.

CPC . *F02F 3/14* (2013.01); *C25D 11/08* (2013.01); *F02B 77/02* (2013.01); *F02F 2001/008* (2013.01); *F02F 2001/249* (2013.01); *F05C 2203/0886* (2013.01); *F05C 2225/00* (2013.01); *F05C 2251/048* (2013.01); *F05C 2253/12* (2013.01); *Y10T 29/49231* (2015.01)

(56) References Cited

U.S. PATENT DOCUMENTS

| | | | | |
|---|---|---|---|---|
| 9,010,297 | B2 * | 4/2015 | Sato | C25D 11/005 123/193.6 |
| 2012/0042859 | A1 | 2/2012 | Sakai | |
| 2013/0146041 | A1 | 6/2013 | Hijii et al. | |

FOREIGN PATENT DOCUMENTS

| | | | |
|---|---|---|---|
| JP | 2001 172795 | | 6/2001 |
| JP | 2003 113737 | | 4/2003 |
| JP | 2005 298945 | | 10/2005 |
| JP | 2007 314840 | | 12/2007 |
| JP | 2009-228064 | A | 10/2009 |
| JP | 2010 249008 | | 11/2010 |
| JP | 2012 46784 | | 3/2012 |
| WO | WO 2010-119977 | A | 10/2010 |

OTHER PUBLICATIONS

Office Action issued Oct. 20, 2015, in Russian Patent Application No. RU 2014109053.

* cited by examiner

INTERNAL COMBUSTION ENGINE AND METHOD FOR MANUFACTURING THE SAME

BACKGROUND OF THE INVENTION

1. Field of the Invention

The present invention relates to an internal combustion engine and a method for manufacturing the same. The present invention relates particularly to an internal combustion engine of which wall surface that faces a combustion chamber of an internal combustion engine is partially or entirely provided with an anodic oxidation coating and a method for manufacturing an internal combustion engine characterized by a method for forming the anodic oxidation coating.

2. Description of Related Art

An internal combustion engine such as a gasoline engine or a diesel engine is mainly configured of an engine block, a cylinder head, and pistons. The combustion chamber thereof is defined by a bore surface of a cylinder block, a piston top incorporated in the bore, a bottom surface of a cylinder head and tops of intake and exhaust valves disposed inside the cylinder head. As a recent internal combustion engine is demanded to be low fuel consumption, it is important to reduce the cooling loss. As one of countermeasures for reducing the cooling loss, a method of forming a heat-insulating coating of ceramic on an internal wall of a combustion chamber can be cited.

However, the above-mentioned ceramics generally has low thermal conductivity and high heat capacity. When an internal wall of a combustion chamber is made of ceramics, due to a steady increase of a surface temperature, an intake efficiency is deteriorated and knocking (irregular combustion due to confinement of heat inside a combustion chamber) is caused; accordingly, the ceramics is not prevailed at the present time as a coating material of an internal wall of a combustion chamber.

From this, a heat insulating coating formed on a wall surface of a combustion chamber is desirably formed of a material that has not only the heat resistance and heat insulating property but also low thermal conductivity and low heat capacity. That is, in order not to steadily raise a wall temperature, it is desirable that, in an intake stroke, the heat insulating coating is low in the heat capacity to decrease the wall temperature following an intake air temperature. Further, in addition to the low thermal conductivity and low heat capacity, a coating is desirably formed of a material that can withstand repeating stress of maximum combustion pressure and fuel injection pressure and thermal expansion and thermal shrinkage during combustion in a combustion chamber, and that is high in the adhesiveness with a base material such as a cylinder block.

A cylinder head in which on both of a bottom surface of a cylinder head and an interior surface of a water jacket defined in the cylinder head, a microporous silicon dioxide or aluminum oxide coating is formed by anodic oxidation is disclosed in Japanese Patent Application Publication No. 2003-113737 (JP 2003-113737 A). According to the cylinder head, since a microporous coating is disposed on both of a head bottom surface and an interior surface of jacket, a surface area of the head bottom surface and interior surface of jacket is expanded by the coating; accordingly, heat generated in the combustion chamber can be efficiently absorbed inside thereof via the coating. On the interior surface of jacket, heat absorbed inside can be efficiently released via the coating into cooling water. Accordingly, a cylinder head of which temperature increase is suppressed and the material is readily heated by absorbing heat or readily cooled by releasing heat can be obtained.

Like this, when an anodic oxidation coating is formed, on a wall surface that faces a combustion chamber of an internal combustion engine, an internal combustion engine that has low thermal conductivity and low heat capacity and is excellent in the heat insulating property can be formed. In addition to these performances, the anodic oxidation coating is further demanded to have excellent temperature swing characteristics. Here, the "temperature swing characteristics" is the characteristics where while having the heat insulating property, a temperature of the anodic oxidation coating follows a gas temperature inside a combustion chamber.

When the anodic oxidation coating is microscopically observed, there are many cracks on a surface thereof. Inside of the anodic oxidation coating, there are many defects that connect to the cracks. It is general that many voids that form these cracks and defects are present over from a surface of the coating to the inside thereof.

The present inventors have identified that these cracks and defects have a dimension in the range of about 1 to 10 μm.

Further, inside of the anodic oxidation coating, in addition to the voids of micro-order, also many fine holes of nano-order (nano-hole) are present.

An anodic oxidation coating generally includes voids such as micro-order surface cracks and internal defects and many nano-holes of nano-order. It has been identified according to the present inventors that while the micro-order voids are desirable to be sealed (embedded, clogged) from the viewpoint of the coating strength, many nano-holes are desirable to remain in the anodic oxidation coating in a state having pores of nano-size from the viewpoint of the temperature swing characteristics.

Here, as a conventional technology that seals the micro-order surface cracks (voids), a corrosion-resistant surface treatment article and a method for producing the same disclosed in Japanese Patent Application Publication No. 2005-298945 (JP 2005-298945 A) can be cited.

JP 2005-298945 A discloses a technology where a silicon component derived from perhydropolysilazane or a polycondensate thereof is filled in the surface cracks to seal.

As disclosed in JP 2005-298945 A, when relatively large size surface cracks are sealed by filling perhydropolysilazane, the voids are sealed and the coating strength can be improved. However, only by filling perhydropolysilazane in an anodic oxidation coating, the nano-holes present inside the coating are also sealed. Accordingly, it is difficult to form an anodic oxidation coating excellent in the temperature swing characteristics.

The present invention provides an internal combustion engine that is provided with an anodic oxidation coating that has low thermal conductivity and low heat capacity, is excellent in heat insulating property, and is excellent in the temperature swing characteristics on a part or an entirety of a wall surface that faces a combustion chamber, and a method for manufacturing the internal combustion engine.

SUMMARY OF THE INVENTION

An internal combustion engine according to a first embodiment of the present invention is an internal combustion engine having an anodic oxidation coating formed on at least a part of a wall surface that faces a combustion chamber, wherein the anodic oxidation coating has voids and nano-holes smaller than the voids; at least a part of the voids are sealed with a sealant derived by converting a sealing agent; and at least a part of the nano-holes are not sealed.

An internal combustion engine in the first embodiment has an anodic oxidation coating (or heat-insulating coating) on at least part of a combustion chamber. On the other hand, in an internal combustion engine in a first embodiment, different from a conventional anodic oxidation coating, at least part of cracks present on a surface thereof and defects present inside thereof (both are voids of micro-order) are sealed with a sealant derived by converting a sealing agent and thereby a high strength coating is formed. Further, in an internal combustion engine in a first embodiment, at least part of many nano-holes (nano-size holes) present in the anodic oxidation coating are not sealed; accordingly, a coating having a structure where many micro pores are contained is formed.

"At least a part of voids are sealed with a sealant derived by converting a sealing agent" means, other than a mode where an entire micro-order voids present in an anodic oxidation coating are sealed with a sealant, a mode where only nano-holes present deeper than a definite depth from a surface layer of the anodic oxidation coating are not sealed. Further, "at least a part of nano-holes are not sealed" means, other than a mode where an entire nano size holes present in the anodic oxidation coating are not sealed, a mode where only nano-holes present up to a definite depth from a superficial layer of the anodic oxidation coating are not sealed. It can be said that a coating mode where an entire micro-order voids are sealed with a sealant and an entire nano-size holes are not sealed is desirable from the viewpoint of both of the hardness of the anodic oxidation coating and the temperature swing characteristics. However, the voids and nano-holes are micro-order or nano-order holes; accordingly, in actuality, a coating mode where only voids on a surface region of the anodic oxidation coating are sealed with a sealant and nano holes of a surface region are not sealed, or a coating mode where voids that are not sealed with a sealant and nano-holes (part of entire nano-holes) that are not sealed are dispersed is obtained.

To "seal" surface cracks and internal defects means to coat a sealing agent on micro-order size voids to bury and clog with a sealant derived by converting the sealing agent. The "sealing agent" is a coating liquid containing an inorganic material, and the "sealant" is a substance derived by converting the coating material containing an inorganic material. According to the present inventors, it has been identified that a dimension of micro-order size voids that the anodic oxidation coating formed on a wall surface that faces a combustion chamber of an internal combustion engine has, is generally in the range of about 1 to 10 μm.

"Nano-holes are not sealed" means that in a mode where nano-holes have nano-size pores, the inside thereof is not clogged with a sealant derived by converting a sealing agent. According to the present inventors, it has been identified that a pore dimension of nano-holes, which the anodic oxidation coating formed on a wall surface that faces a combustion chamber of an internal combustion engine has, is generally in the range of about 20 to 200 nm. The identification of the range of 1 to 10 μm and the range of 20 to 200 nm can be conducted in such a manner that from SEM image photograph data and TEM image photograph data of a cross-section of the anodic oxidation coating, voids and nano-holes in a definite area respectively are extracted and the maximum dimensions thereof are measured, and the respective average values are obtained to identify the size.

An internal combustion engine in a first embodiment may be any one for use in a gasoline engine and a diesel engine. The configuration thereof is mainly configured of an engine block, a cylinder head, and a piston. The combustion chamber thereof is defined by a bore surface of a cylinder block, a piston top incorporated in the bore, a bottom surface of a cylinder head and tops of intake and exhaust valves disposed inside the cylinder head.

The anodic oxidation coating may be formed either on an entire wall surface facing the combustion chamber or on only a part thereof. In the case of the latter, an embodiment where the anodic oxidation coating is formed only on a piston top or a valve top can be cited.

Further, examples of base materials that configure a combustion chamber of an internal combustion engine include aluminum and alloys thereof, titanium and alloys thereof, and iron base materials plated with aluminum further anodically oxidized. An anodic oxidation coating formed on a wall surface that is configured of a base material of aluminum or an alloy thereof becomes alumite. Not only in the case of a general aluminum alloy but also in the case of high strength aluminum alloy having a higher composition ratio of a copper component, a nickel component and a titanium component than the above, a dimension of voids that configure the surface cracks or internal defects tends to be larger. Accordingly, an improvement in the coating strength when a sealing agent is coated on these voids and converted into a sealant becomes more remarkable.

According to a first internal combustion engine, among an anodic oxidation coating formed on at least a part of a wall surface that faces a combustion chamber thereof, at least a part of relatively large voids of micro-order size are sealed with a sealant derived by converting a sealing agent, and at least a part of nano-holes of nano-order size are not sealed. Thereby, an internal combustion engine that has an anodic oxidation coating that is excellent in heat insulating property, high in the mechanical strength, and excellent also in the temperature swing characteristics in which a surface temperature of the anodic oxidation coating follows a gas temperature in a combustion chamber is obtained.

The sealant may be a substance mainly made of silica.

As the sealing agent that forms the sealant, any one kind of polysiloxane, polysilazane, and sodium silicate may be applied. A polysiloxane or polysilazane coating material that contains a normal temperature-curable inorganic substance that has the viscosity capable of smoothly permeating into voids in the anodic oxidation coating, can be cured without applying high temperature treatment (sintering) and is very high in the hardness of a sealant obtained by curing may be applied.

A second embodiment of the present invention is a method for manufacturing an internal combustion engine in which an anodic oxidation coating is formed on at least a part of a wall surface that faces a combustion chamber includes: sealing a periphery of nano-holes, the anodic oxidation coating having voids and the nano-holes smaller than the void inside thereof; and coating a sealing agent on the voids to seal at least a part of the voids with a sealant derived by converting the sealing agent to form the anodic oxidation coating where at least a part of nano-holes are not sealed.

In an anodic oxidation coating that faces a combustion chamber of an internal combustion engine, as a method for forming the anodic oxidation coating in such a manner that at least a part of micro-order size voids are sealed and at least a part of nano-holes of nano-order size are not sealed, a periphery of nano-holes is sealed to form nano-holes that form a closed space.

The "sealing treatment" is a process where a surface wall of nano-holes is formed (by expanding a surface wall of nano-holes) to secure pores of nano size inside thereof. Examples of the sealing treatments include embodiments of the following plurality of treatment methods.

That is, a method where an anodic oxidation coating is placed in pressurized water vapor, a method where an anodic oxidation coating is dipped in boiled water, and a method where an anodic oxidation coating is dipped in a solvent containing an inorganic substance or an organic substance can be cited.

In any of the methods, a periphery of an initial nano-hole expands and a coating formed by the expansion is formed inside of the nano-hole, nano-size pores configuring a nano-hole are defined by an expanded coating to secure pores. In a state of a nano hole before the step of sealing a nano-size hole is not completely defined from a region outside thereof and a shape of a nano-size pore is not retained. Accordingly, in a state as it is, a sealing agent coated in the second step described below intrudes into the inside of the nano-hole to seal with a sealant derived by converting this.

On the other hand, it was found by the present inventors that according to the step of sealing like this, voids such as micro-order size surface cracks and internal defects cannot be sealed. As described above, the "sealing treatment" is a process where a surface wall of pore is completely defined from a region outside thereof (by expanding a surface wall of pore to shrink an inner diameter of pore). However, in a micro-order size void, a void size is too large to form an expansion coating so as to completely define an entire surface of a void from the outside thereof.

In the first step, as was described above, many nano-holes of a size in the range of about 20 to 200 nm are formed (defined) in an anodic oxidation coating.

In the second step, a sealing agent is coated on voids of micro-order size and a sealant derived by converting the sealing agent seals at least a part of the voids. Thereby, an anodic oxidation coating in which at least a part of nano-holes are not sealed can be formed.

Here, examples of the sealing agents include, as was described above, polysiloxane and polysilazane. This is because when these are used, a high temperature heat treatment (sintering) can be dispensed with, the sealing agent can be relatively easily permeated into the inside of micro-size voids, and, after curing, a hard body (for example, silica glass) high in the hardness is formed and the strength of an anodic oxidation coating can be improved.

Further, a method for coating a sealing agent is not particularly restricted. However, a method where an anodic oxidation coating is dipped in a sealing agent, a method where a sealing agent is sprayed to a surface of an anodic oxidation coating, a blade coating method, a spin coating method, and a brush coating method can be applied.

Since a surface of nano-hole is sealed in the first step, a sealing agent coated in the second step is inhibited from intruding into nano-holes. As a result, an internal combustion engine having an anodic oxidation coating excellent in the temperature swing characteristics on at least a part of a combustion chamber can be manufactured.

According to the present inventors, it is estimated that, with a turbocharged direct injection diesel engine for passenger vehicles for example, at the number of rotations of 2100 rpm, and at a best fuel consumption point corresponding to average effective pressure of 1.6 MPa, the maximum improvement in the fuel consumption of 5% can be obtained. An improvement of 5% in the fuel consumption is a value that is not covered by measurement error upon measuring but a value that can be clearly verified as a significant difference. Further, simultaneously with the improvement in the fuel consumption, it is also estimated that an exhaust gas temperature goes up by about 15° C. owing to heat insulation. An increase in the exhaust gas temperature is effective in shortening a warm-up time of a $NO_x$ reduction catalyst immediate after a start in an actual machine and a value where a $NO_x$ reduction rate is improved and $NO_x$ reduction can be realized can be obtained.

On the other hand, a cooling test (rapid cooling test) that is conducted when evaluating the temperature swing characteristics of an anodic oxidation coating is conducted in the following manner. That is, with a test piece on one side of which an anodic oxidation coating is formed, while continuing heating the other side (a side on which the anodic oxidation coating is not formed) with a predetermined high temperature jet flow, a cooling air of a predetermined temperature is sprayed from a front side of a test piece (a side on which the anodic oxidation coating is formed) to decrease a front temperature of the test piece, a temperature thereof is measured, a cooling curve of a coating surface temperature and a time is prepared, thereby a rate of temperature decrease is evaluated. The rate of temperature decrease is evaluated as a 40° C. decrease time by reading a time necessary to decrease a coating surface temperature by 40° C. from a graph.

A plurality of test pieces is subjected to a rapid cooling test, the 40° C. temperature decrease time of each of test pieces is measured, and an approximate curve of a plurality of plots defined by a fuel consumption improvement rate and the 40° C. temperature decrease time is obtained.

Then, when a value of the 40° C. temperature decrease time corresponding to the fuel consumption improvement rate of the 5% is read, it is identified to be 45 m-sec by the present inventors. The shorter the 40° C. temperature decrease time is, the lower the thermal conductivity and heat capacity of a coating is, and the higher an improvement effect of the fuel consumption is.

According to an internal combustion engine and a method for manufacturing the same in the embodiment of the present invention, when nano size holes present inside of an anodic oxidation coating that is formed on a wall surface that faces a combustion chamber thereof are sealed, many of nano-holes are rendered non-permeative of a sealing agent and at least a part of nano-holes are not sealed, then, when a sealing agent is coated on relatively large voids of micro-order, at least part of the voids are sealed with a sealant derived by converting the sealing agent. Thereby, an internal combustion engine that has an anodic oxidation coating that is excellent in the heat insulating property, high in the mechanical strength and excellent in the temperature swing characteristics on at least a part of or an entirety of a wall surface that faces a combustion chamber can be manufactured.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

In what follows, with reference to the drawings, embodiments of an internal combustion engine of the present invention and a method for manufacturing the same will be described. An illustration example shows a mode where an anodic oxidation coating is formed on an entire wall surface that faces a combustion chamber of an internal combustion engine. However, a mode where an anodic oxidation coating is formed only on a part of a wall surface that faces a combustion chamber such as only on a piston top or a valve top can be used.

Figure 1:
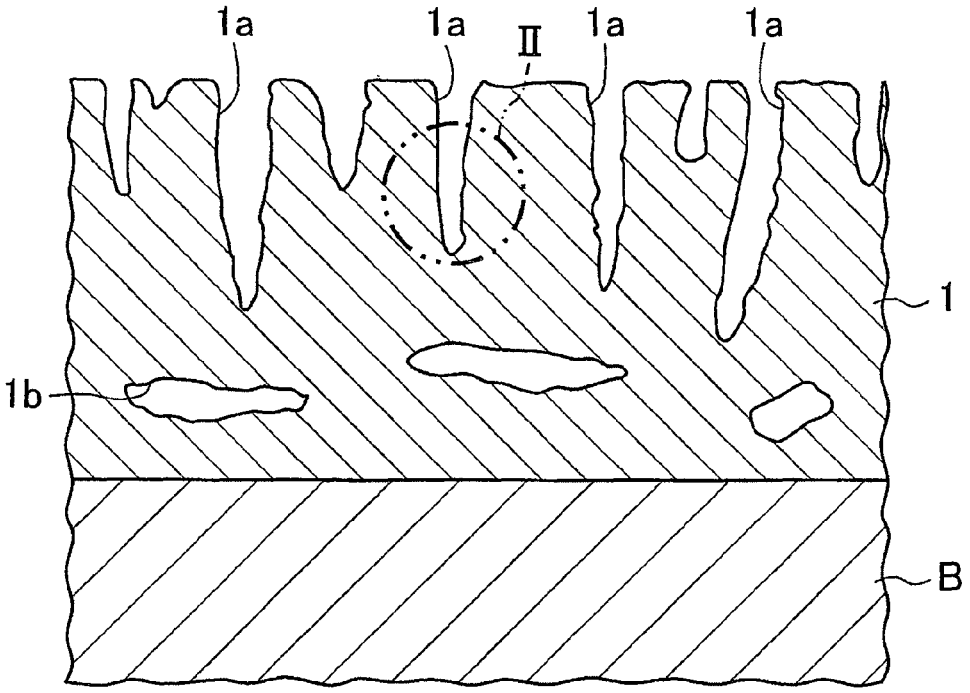
FIG. 1 is a vertical cross-sectional view that simulates a state before applying a treatment on voids and nano-holes in an anodic oxidation coating formed on a wall surface that faces a combustion chamber of an internal combustion engine relating to an embodiment of the present invention.
Figure 2:
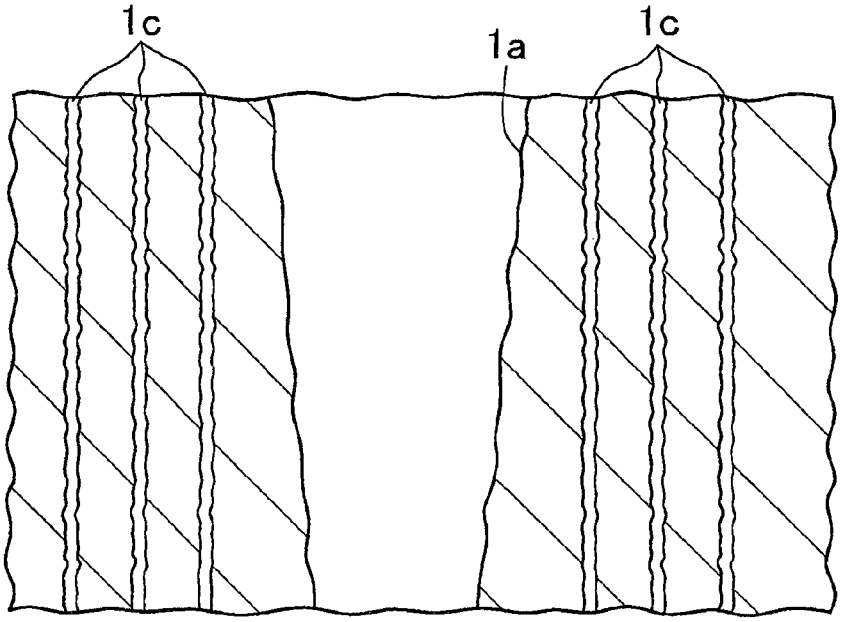
FIG. 2 is an enlarged diagram of a II part of FIG. 1.
Figure 3A:
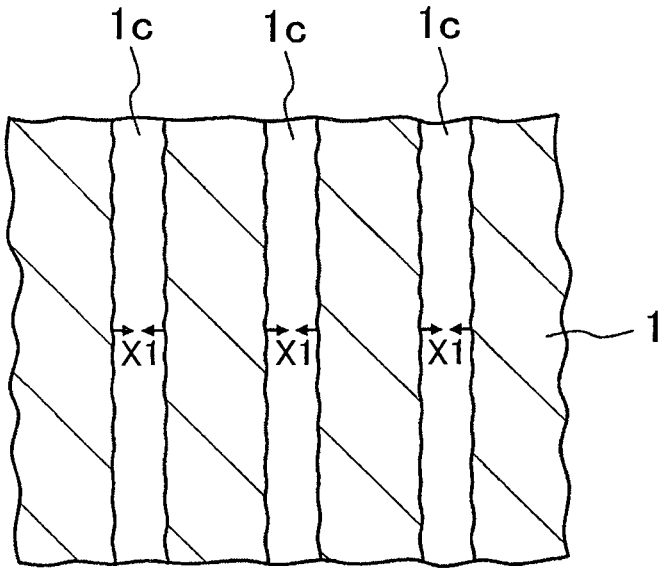
FIG. 3A and FIG. 3B are schematic diagrams sequentially explaining a sealing step of a method for manufacturing an internal combustion engine relating to an embodiment of the present invention.
Figure 3B:
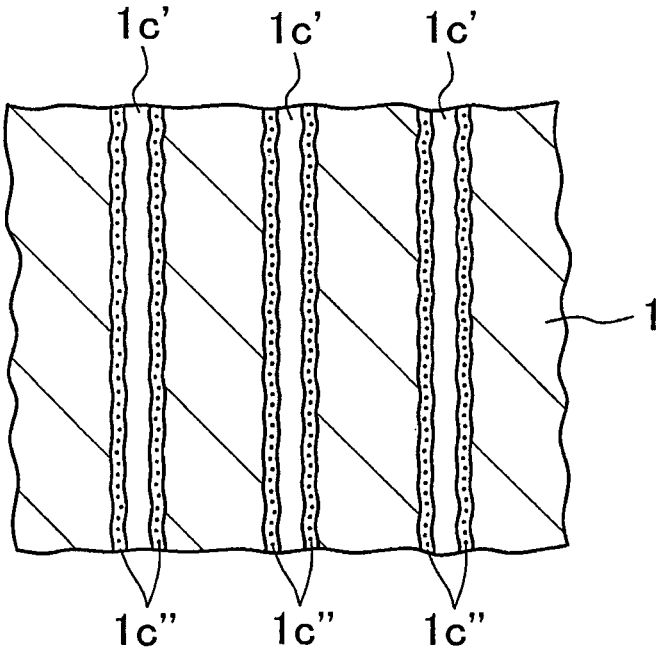
Figure 4:
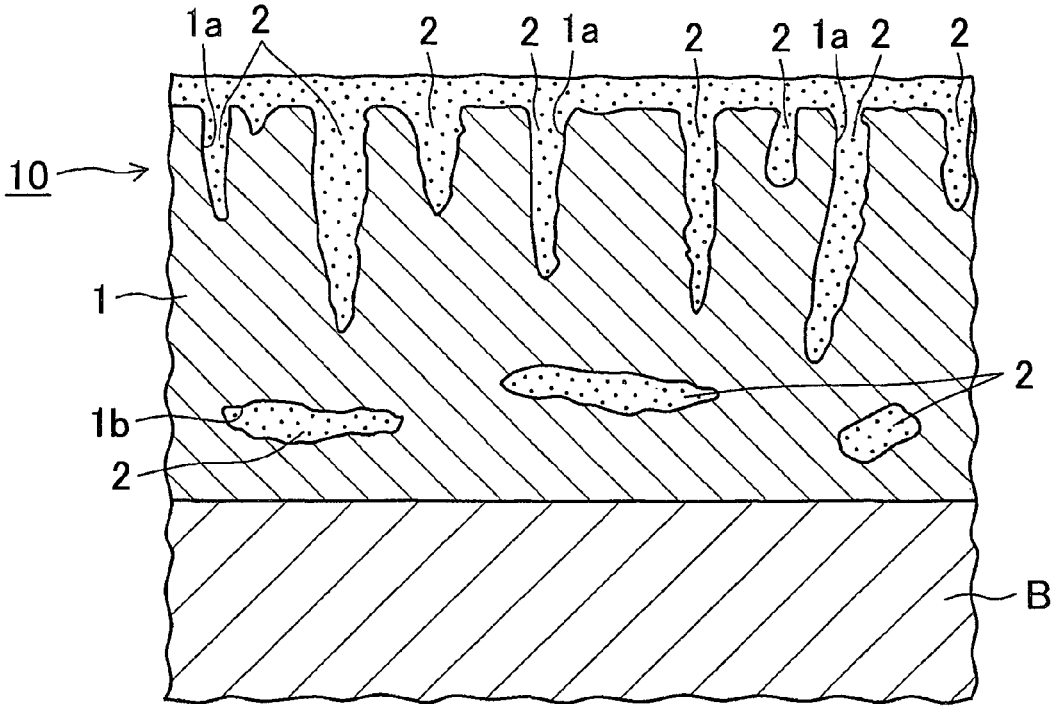
FIG. 4 is a schematic diagram for describing a step of forming an anodic oxidation coating, and is a diagram for describing the anodic oxidation coating formed according to a method for manufacturing an internal combustion engine of the present embodiment of the present invention.

FIGS. 1 to 4 show in this order flow-charts of a method for manufacturing an internal combustion engine. More specifically, FIG. 1 is a vertical cross-sectional view that simulates a state before applying a treatment on voids and nano-holes, FIG. 2 is an enlarged diagram of a II part of FIG. 1, FIG. 3A and FIG. 3B are, in this order, schematic diagrams for explaining a sealing step of a method for manufacturing an internal combustion engine of the present embodiment, and FIG. 4 is a schematic diagram for describing a step of forming an anodic oxidation coating and a diagram for describing the anodic oxidation coating formed according to a method for manufacturing an internal combustion engine of the present embodiment.

Firstly, an anodic oxidation step is applied on a wall surface that faces a combustion chamber of a not-shown internal combustion engine to form an anodic oxidation coating. That is, an internal combustion engine is mainly configured of a cylinder block, a cylinder head, and pistons. The combustion chamber thereof is defined by a bore surface of a cylinder block, a piston top incorporated in the bore, a bottom surface of a cylinder head and intake and exhaust valve tops disposed inside of the cylinder head. The anodic oxidation coating is formed on an entirety of a wall surface that faces a combustion chamber.

Further, examples of base materials that configure a combustion chamber of an internal combustion engine include aluminum and alloys thereof, titanium and alloys thereof, and iron base materials plated with aluminum further anodically oxidized. An anodic oxidation coating formed on a wall surface that is configured of a base material of aluminum or an alloy thereof becomes alumite.

As shown in FIG. 1, when an anodic oxidation coating 1 formed on a surface of an aluminum base material B that configures a wall surface of a combustion chamber is microscopically observed, on a surface thereof, many cracks 1*a* are present. Inside of the anodic oxidation coating 1, many defects that continue to the cracks 1*a* are present. In general, many voids that form these cracks 1*a* and defects 1*b* are present over from a surface of a coating to the inside thereof.

The cracks 1*a* and defects 1*b* have a micro-order size in the range of about 1 to 10 μm. Not only in the case of general aluminum alloys but also in the case of high strength aluminum alloys in which the composition ratios of copper component, nickel component and titanium component are higher than the above, a dimension of voids that configure the surface cracks and internal defects tend to be larger.

Further, in the inside of the anodic oxidation coating 1, as shown in FIG. 2, other than the surface cracks 1*a* and the internal defects 1*b* of micro-order voids, also many holes of nano-order size (nano-holes) 1*c* are present. A pore dimension of the nano-holes is generally in the range of about 20 to 200 nm.

A method for manufacturing an internal combustion engine in the present embodiment includes the step of treating to improve performance of an anodic oxidation coating formed on a wall surface that faces a combustion chamber of an internal combustion engine. In the present embodiment, the anodic oxidation coating is formed in such a manner that at least a part of the cracks 1*a* and defects 1*b* of micro-order size void (that is, an entirety thereof or what is present in the range from a surface layer to a definite depth of a coating 1) are sealed and at least a part of nano-order size nano-holes 1*c* (that is, an entirety thereof or what is present in the range from a surface layer to a depth deeper than the definite depth of a coating 1) are not sealed. As a first step of the method for manufacturing, a periphery of nano-holes 1*c* is sealed to form a nano-hole that forms an enclosed space.

The step of sealing is a step where a surface wall of nano-hole is formed (the surface wall of nano-hole is expanded to shrink an internal diameter of a nano-hole) to secure a pore of nano-size inside thereof. Thereby, a sealing agent that is coated in the second step is inhibited from intruding into the inside of nano-hole and sealing the same.

As the sealing step, a method where an anodic oxidation coating is placed in pressurized water vapor, a method where an anodic oxidation coating is dipped in boiling water, or a method where an anodic oxidation coating is dipped in a solvent containing an inorganic substance or an organic substance can be cited.

According to a method where an anodic oxidation coating is placed in pressurized water vapor, a combustion chamber-forming member, which is provided with the anodic oxidation coating, is, after thoroughly washing with water, placed in a pressure-tight vessel and sealed by flowing water vapor of 3 to 5 atmospheric pressure into the vessel for 20 to 30 min.

According to a method where an anodic oxidation coating is dipped in boiling water, after thoroughly washing a combustion chamber-forming parts provided with an anodic oxidation coating, the parts is dipped in a water bath of pure water heated to 95 to 100° C. (pH: from 5.5 to 6.5) for 30 min to seal.

According to a method where an anodic oxidation coating is dipped in a solvent containing an inorganic substance or an organic substance, a combustion chamber-forming parts is dipped in a water bath of nickel acetate or cobalt acetate and the water bath is kept at 95° C. or more for 10 to 20 min.

When an anodic oxidation coating is placed in water vapor or a high temperature water bath, as shown in FIG. 3A, a coating of a periphery of a nano-hole 1*c* expands (blister) in a direction toward the inside of the nano-hole 1*c* (X1 direction), and, finally, as shown in FIG. 3B, by a coating 1*c*" formed by expansion, a nano-size (nano-hole 1*c*') is defined in a state where a liquid can not intrude from the outside thereof. According to the first step, many nano-holes 1*c*' having a size in the range of about 20 to 200 nm are formed (defined) in the anodic oxidation coating.

Then, as a second step, as shown in FIG. 4, a sealing agent 2 is coated on cracks 1*a* and defects 1*b* of voids of micro-order size to seal at least a part of the voids. Thereby, an anodic oxidation coating 10 where at least a part of nano-holes 1*c*' in a state where a liquid can not intrude due to the expanded coating 1*c*" are not sealed is formed.

Here, examples of methods for coating a sealing agent 2 include a method where an anodic oxidation coating is dipped in a vessel where a sealing agent 2 is accommodated, a method for spraying a sealing agent 2 to a surface of an anodic oxidation coating, a blade coating method, a spin coating method and a brush coating method.

As the sealing agent 2, polysiloxane and polysilazane can be cited. This is because the use thereof can dispense with a high temperature heat treatment (sintering), the sealing agent can be relatively easily permeated into the inside of micro-size cracks 1*a* and defects 1*b*, and, after curing, a hard body such as silica glass high in the hardness is formed to result in improving the strength of an anodic oxidation coating 10.

Since a surface of the nano-hole is sealed in the first step, a sealing agent coated in the second step is inhibited from intruding into the nano-hole. As a result, an internal combustion engine provided with an anodic oxidation coating excellent in the temperature swing characteristics on at least a part of a combustion chamber thereof can be produced.

Figure 5:
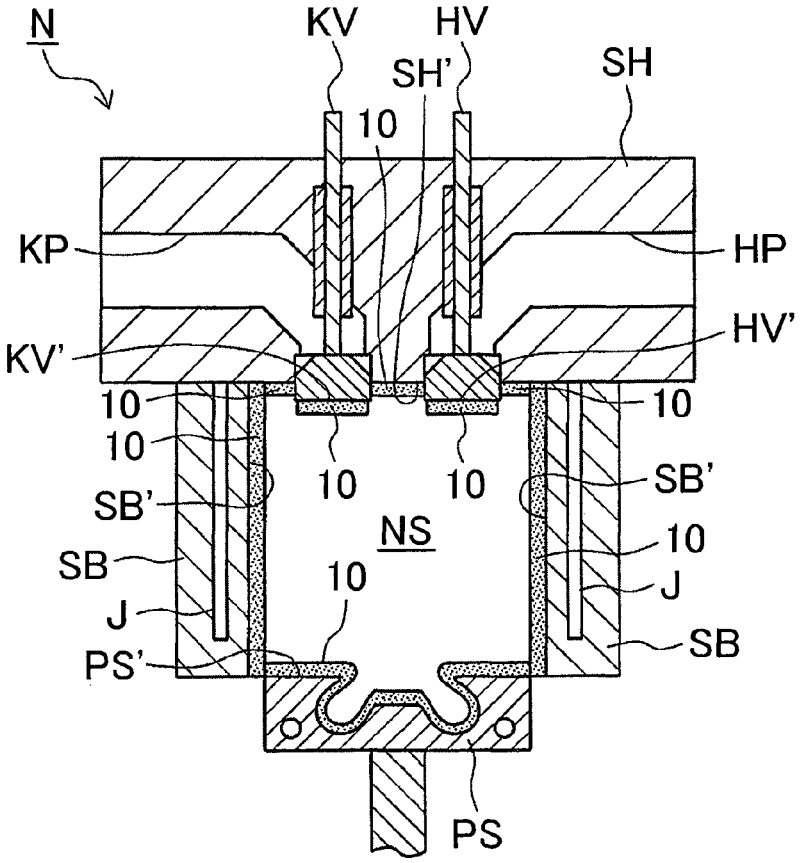
FIG. 5 is a vertical cross sectional view that simulates an internal combustion engine that is formed by applying a method for manufacturing of the present embodiment to an anodic oxidation coating formed on an entirety of a wall surface that faces a combustion chamber.

FIG. 5 simulates an internal combustion engine that is provided with an anodic oxidation coating on an entire wall surface that faces the combustion chamber according to the method for manufacturing.

An internal combustion engine N illustrated in FIG. 5 is for example a diesel engine. The internal combustion engine N roughly includes a cylinder block SB which has a cooling water jacket J inside thereof, a cylinder head SH disposed on the cylinder block SB, an intake port KP and exhaust port HP defined in the cylinder head SH, an intake valve KV and an exhaust valve HV which are attached freely elevatable to openings where the intake port KP and the exhaust port HP face a combustion chamber NS, and a piston PS formed freely elevatable from a lower opening of the cylinder block SB. The present invention may be applied to a gasoline engine.

The respective constituent parts configuring the internal combustion engine N are all formed of aluminum or an alloy thereof (including high strength aluminum alloy).

In a combustion chamber NS defined by the respective constituent parts of an internal combustion engine N, on wall surfaces where the respective constituent parts face a combustion chamber NS (cylinder bore surface SB', cylinder head bottom surface SH', piston top PS', valve tops KV' and HV'), an anodic oxidation coating 10 is formed.

[Cooling Test and Results Thereof] The present inventors prepared a plurality kinds of test pieces by forming an anodic oxidation coating under the condition shown in Table 2 to a base material having a component composition (aluminum alloy (AC8A)) shown in the following Table 1, conducted a cooling test to evaluate the temperature swing characteristics of the anodic oxidation coating, simultaneously conducted the strength test and further conducted an experiment to obtain relationship between the temperature swing characteristics and the strength of the anodic oxidation coating.

TABLE 1

| Component | Cu | Si | Mg | Zn | Fe | Mn | Ni | Ti | Al |
|---|---|---|---|---|---|---|---|---|---|
| Aluminum alloy (AC8A) (% by mass) | 0.99 | 12.3 | 0.98 | 0.11 | 0.29 | <0.01 | 1.27 | <0.01 | Balance |

TABLE 2

| Electrolyte solution | Liquid temperature (° C.) | Current density (mA/cm$^2$) | Treatment time (minute) | Average coating thickness (μm) |
|---|---|---|---|---|
| 20% sulfuric acid | 0 | 90 | 60 | 180 |

Upon forming an anodic oxidation coating, a sealing agent contains polysiloxane or polysilazane as a main component and isopropyl alcohol, xylene, or dibutyl ether as a solvent.

Figure 6A:
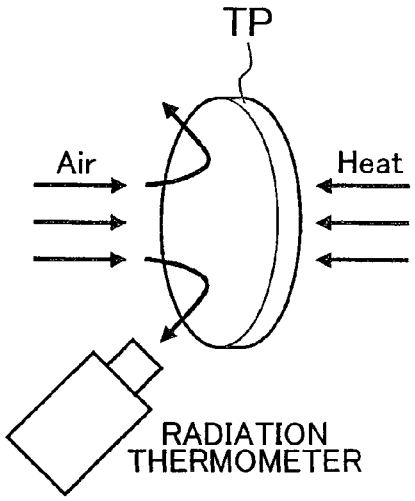
FIG. 6A is a schematic diagram for describing an outline of a cooling test.
Figure 6B:
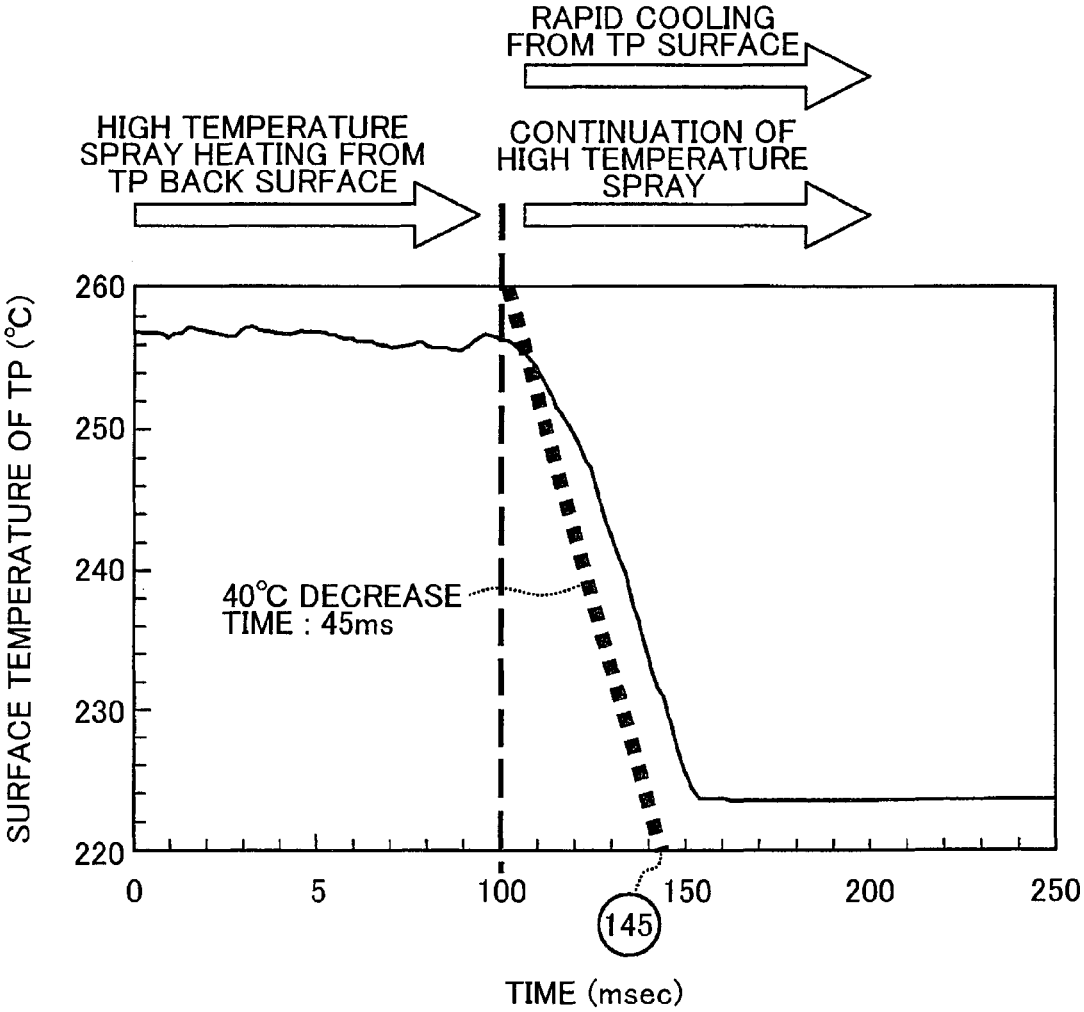
FIG. 6B is a diagram showing a cooling curve based on the result of the cooling test and a 40° C. decrease time derived therefrom.

An outline of the cooling test is as shown below. As illustrated in FIG. 6A, with a test piece TP only on one side of which an anodic oxidation coating is formed, the other side (a side that is not provided with the anodic oxidation coating) is heated (Heat in the drawing) by high temperature spray of 750° C. to stabilize an entire test piece TP at about 250° C., a nozzle from which a room temperature jet is flown in advance at a predetermined flow rate is moved by a linear motor to a front (a surface provided with the anodic oxidation coating) of a test piece TP to start cooling (to provide cooling air (Air in the drawing) of 25° C. and the high temperature spray on the other side is continued at this time). A temperature of a surface of the anodic oxidation coating of a test piece TP is measured with a radiation thermometer present outside thereof, a temperature decrease during cooling is measured, and a cooling curve illustrated in FIG. 6B is prepared. The cooling test is a test method that simulates an intake step of an internal wall of a combustion chamber and evaluates a cooling rate of a surface of a heated heat-insulating coating. In the case of a heat insulating coating having low thermal conductivity and low heat capacity, the cooling rate tends to be faster.

From the prepared cooling curve, a time necessary for a temperature to decrease by 40° C. is read to evaluate the thermal characteristics of a coating as the 40° C. decrease time.

On the other hand, according to the present inventors, as a value that can clearly verify the fuel consumption improvement rate without burying as measurement error upon experiment, can shorten a warm-up time of a $NO_x$ reduction catalyst due to an increase in an exhaust gas temperature and can realize $NO_x$ reduction, 5% of the fuel consumption improvement rate is considered as a target value achieved by performance of an anodic oxidation coating configuring a combustion chamber of an internal combustion engine of the present embodiment. Here, in FIG. 7, a correlation graph of the fuel consumption improvement rate identified by the present inventors and the 40° C. decrease time in the cooling test is shown.

Figure 7:
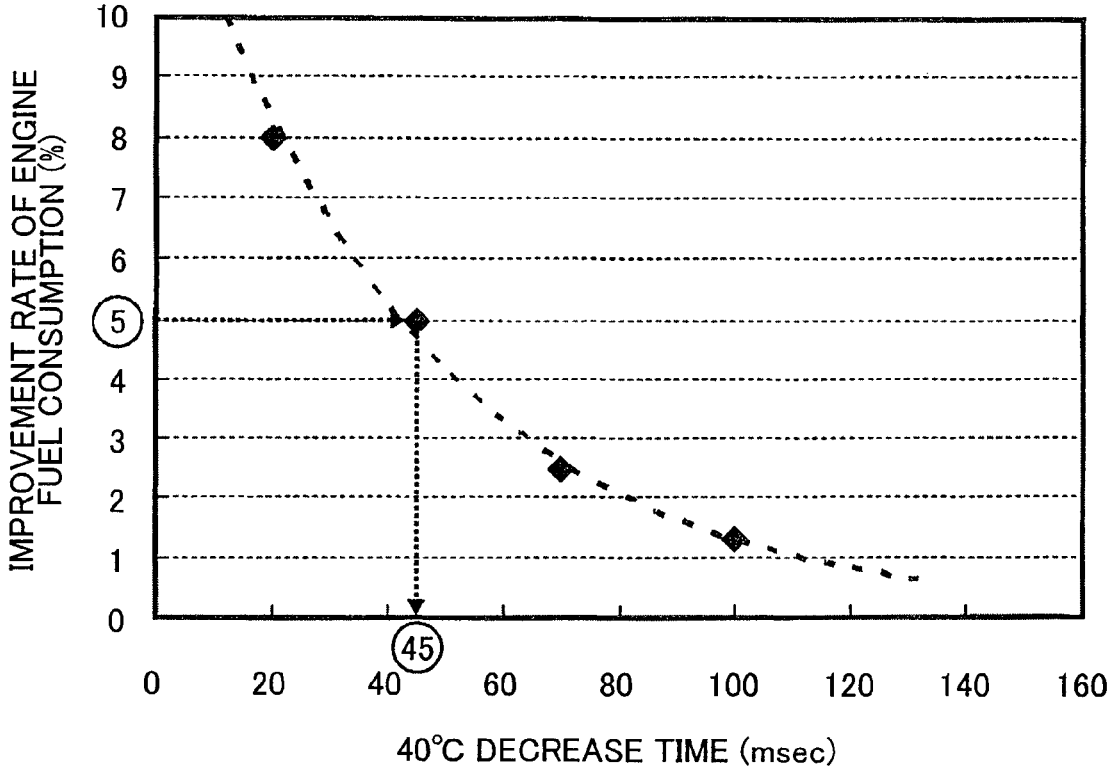
FIG. 7 is a diagram showing a correlation graph of a fuel consumption improvement rate and the 40° C. decrease time in the cooling test.

From FIG. 7, the 40° C. decrease time corresponding to 5% of the fuel consumption improvement rate in the cooling test is identified as 45 msec; accordingly, 45 msec or less can be taken as an indicator that shows excellent temperature swing characteristics On the other hand, the mechanical strength is evaluated by applying micro Vickers hardness test. A portion to be evaluated is set to a center part of a cross-section of an anodic oxidation coating and a weight is set to 0.025 kg.

Test results are shown in the following Table 3 and FIG. 8.

TABLE 3

| | Main component of sealing agent | Sealing condition: Sealing treatment | Sealing condition: Coating thickness (μm) | Hardness HV0.025 | 40° C. decrease time (msec) |
|---|---|---|---|---|---|
| Example 1 | Polysiloxane | Holding for | 5 | 400 | 42.5 |
| Example 2 | Polysilazane | 30 min or more | 5 | 500 | 42.5 |
| Comparative example 1 | No sealing agent | in boiling pure water | — | 150 | 42 |
| Comparative example 2 | Polysiloxane | None | 5 | 500 | 46 |
| Comparative example 3 | Polysilazane | | 5 | 600 | 46 |
| Comparative example 4 | No sealing agent | | — | 150 | 42 |

Figure 8:
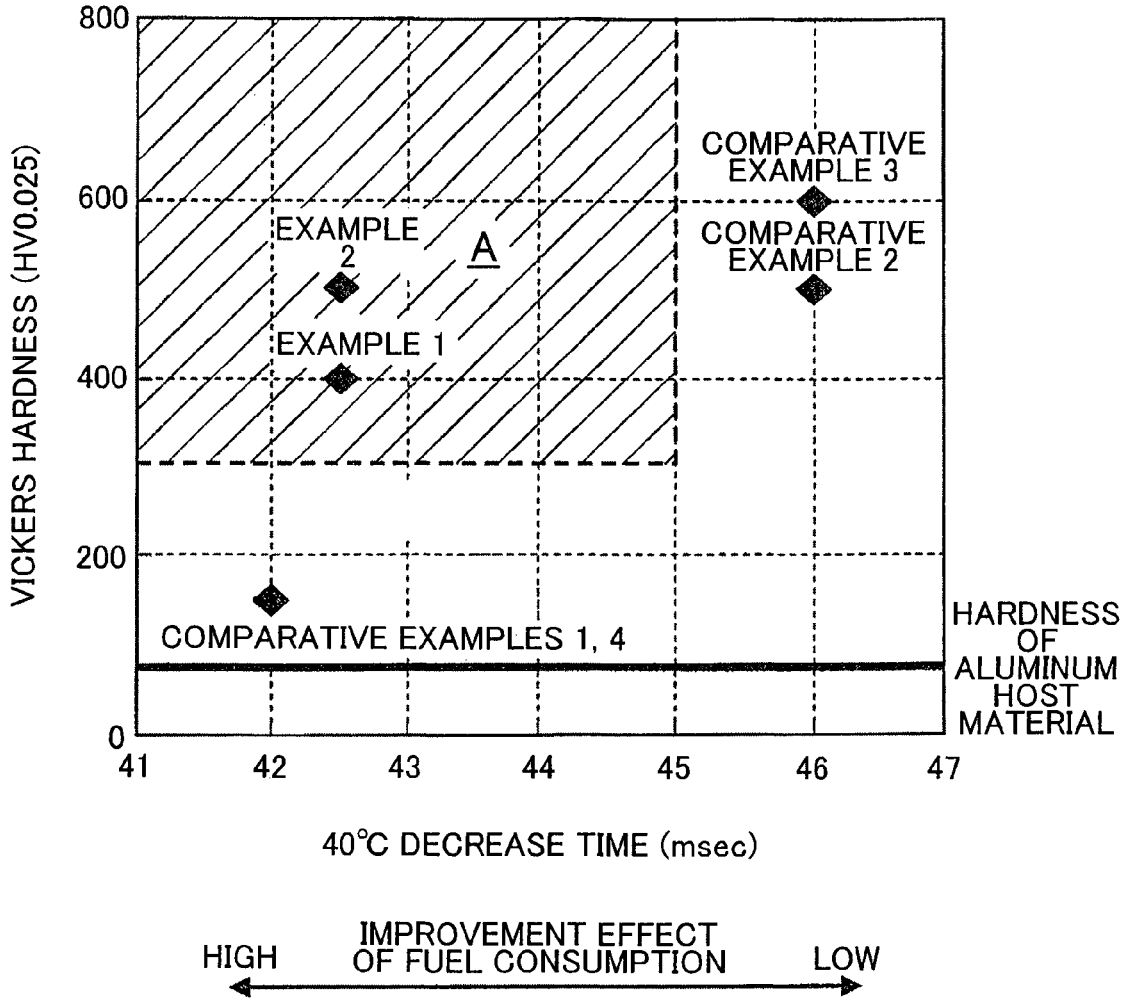
FIG. 8 is a diagram showing experimental results from which the temperature swing characteristics and the mechanical strength of an anodic oxidation coating are obtained.

In FIG. 8, a correlation graph of hardness-40° C. decrease time of an aluminum alloy, which was identified by the present inventors is shown. A region A of FIG. 8 where the fuel consumption improvement rate is 45 msec or less and the Vickers hardness: HV0.025 is 300 or more can be considered a region excellent in both of the temperature swing characteristics and the hardness (this region is a region showing more excellent performance than that of aluminum alloy). Both of examples 1 and 2 are verified to be within the region A.

Both of examples 1 and 2 are provided with an anodic oxidation coating where voids of micro-order size, which form cracks and defects, are sealed with a sealing agent and many nano-holes are not sealed. Thereby, it is verified that both of examples 1 and 2 have the hardness and the temperature swing characteristics the same as or more than that of the aluminum alloy material.

The present inventors further took SEM images of a surface and the inside of an anodic oxidation coating of example 1, further took SEM images of the inside by increasing magnification, and observed a state of sealing of surface cracks and internal defects with a sealing agent and a state of nano-holes. The respective SEM image photographs are shown in FIGS. 9A and 9B.

Figure 9A:
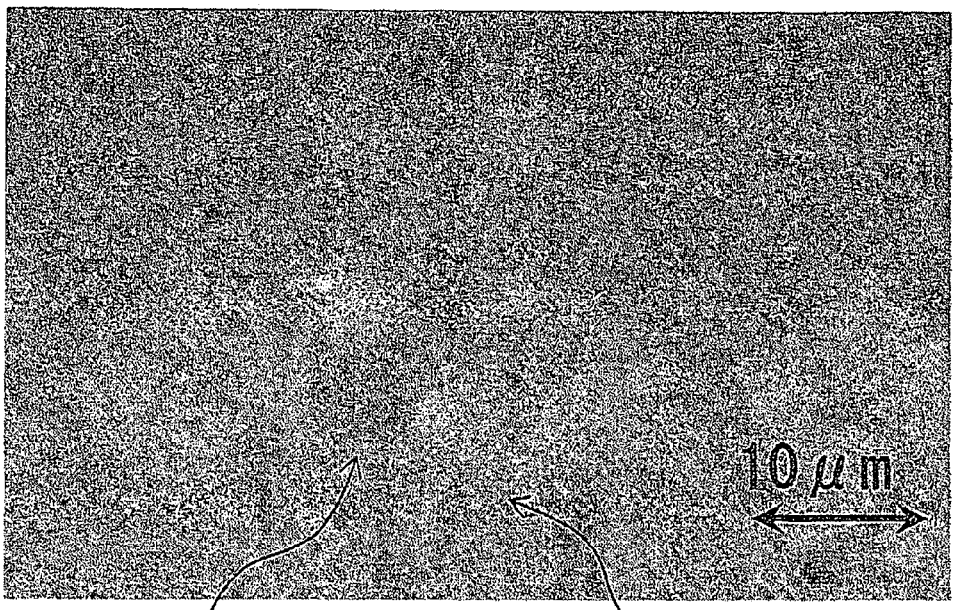
FIG. 9A is a SEM image photograph showing a state where micro-order size voids configuring surface cracks and internal defects are sealed with a sealing agent.

From FIG. 9A, it can be confirmed that a sealing agent is filled in the surface cracks and internal defects of an anodic oxidation coating and voids thereof are sealed with a sealant derived by converting the sealing agent.

Figure 9B:
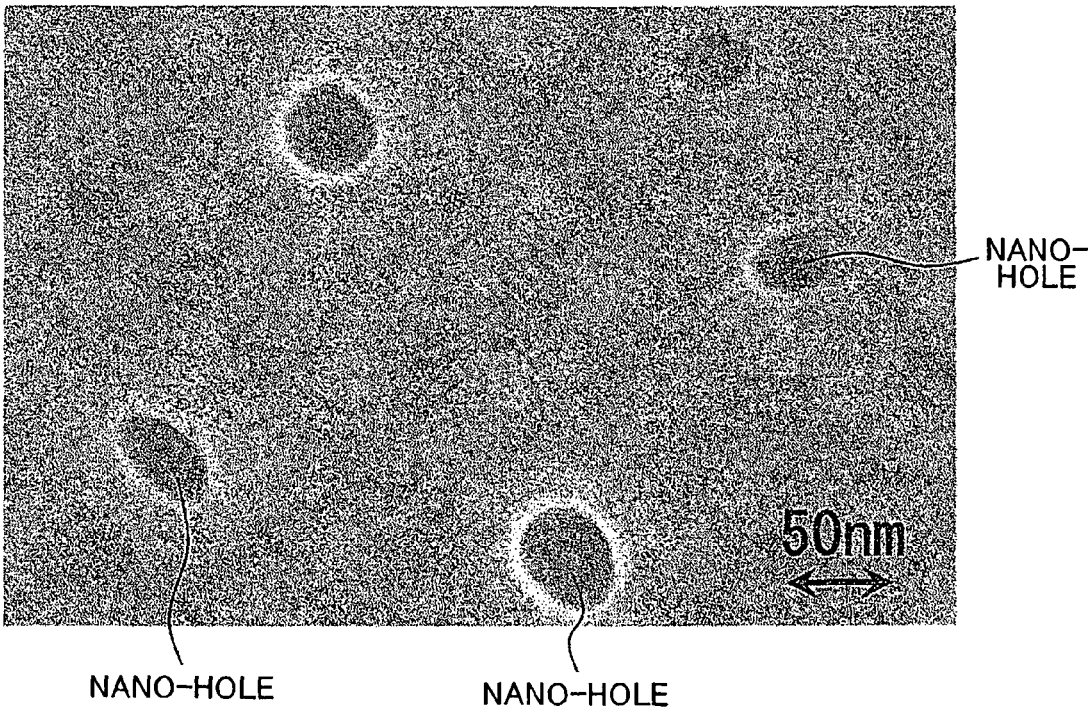
FIG. 9B is a SEM image photograph showing nano-holes.

On the other hand, from FIG. 9B, it can be confirmed that a nano-hole inside of the anodic oxidation coating is provided with an expanding coating in the periphery thereof (white portion of nano-hole surface) and pores of nano-size are present.

The invention claimed is:

1. An internal combustion engine having an anodic oxidation coating formed on at least a part of a wall surface that faces a combustion chamber, characterized in that:

the anodic oxidation coating has voids and nano-holes smaller than the voids;

at least a part of the voids are sealed with a sealant derived by converting a sealing agent; and at least a part of the nano-holes are not sealed.

2. The internal combustion engine according to claim 1, wherein the sealant is a substance mainly made of silica.

3. The internal combustion engine according to claim 1, wherein the sealing agent is any one of polysiloxane or polysilazane.

4. A method for manufacturing an internal combustion engine in which an anodic oxidation coating is formed on at least a part of a wall surface that faces a combustion chamber comprising:

sealing a periphery of nano-holes, the anodic oxidation coating having voids and the nano-holes smaller than the voids inside thereof; and coating a sealing agent on the voids and sealing at least a part of the voids with a sealant derived by converting the sealing agent to form the anodic oxidation coating and at least a part of nano-holes are not sealed.

5. The method according to claim 4, wherein the sealant is a substance mainly made of silica.

6. The method according to claim 4, wherein the sealing agent is any one of polysiloxane or polysilazane.

7. The method according to claim 4, wherein sealing is any one of a method where an anodic oxidation coating is placed in pressurized water vapor, a method where an anodic oxidation coating is dipped in boiling water, and a method where an anodic oxidation coating is dipped in a solvent containing an inorganic substance or an organic substance.

* * * * *